United States Patent [19]

Weirich et al.

[11] Patent Number: 4,534,681

[45] Date of Patent: Aug. 13, 1985

[54] MINE ROOF SUPPORTS

[75] Inventors: Walter Weirich, Dortmund; Michael Dettmers, Kamen, both of Fed. Rep. of Germany

[73] Assignee: Gewerkschaft Eisenhutte Westfalia, Lunen, Fed. Rep. of Germany

[21] Appl. No.: 534,524

[22] Filed: Sep. 21, 1983

[30] Foreign Application Priority Data

Oct. 12, 1982 [DE] Fed. Rep. of Germany ..... 3237719

[51] Int. Cl.[3] ..... E21D 15/44

[52] U.S. Cl. ..... 405/294; 405/302

[58] Field of Search ..... 405/291, 293, 294, 302, 405/295; 91/170 MP; 299/33

[56] References Cited

U.S. PATENT DOCUMENTS 3,534,559 10/1970 Seddon et al. ..... 405/294
4,306,822 12/1981 Weirich et al. ..... 405/294
4,411,558 10/1983 Rutherford ..... 405/294

FOREIGN PATENT DOCUMENTS 2705461 5/1978 Fed. Rep. of Germany ..... 405/294

*Primary Examiner*—David H. Corbin
*Attorney, Agent, or Firm*—Sughrue, Mion, Zinn, Macpeak and Seas

[57] ABSTRACT

A mine roof support has a main roof-engaging structure 2 carried by hydraulic props 6 in known manner and an auxiliary roof-engaging structure at the front end of the main roof engaging structure. The auxiliary roof-engaging structure can be swung up and down and is itself of multi-part construction with one component 7 directly linked to the main structure and another selectively extendible forward component 8 mounted to the one component. One hydraulic piston and cylinder unit 9 is provided for swinging the auxiliary structure and for setting the structure against the roof and another such unit 10 is provided for selectively extending and retracting the forward component thereof. A hydraulic control arrangement 16–18 associated with the units ensures that when the forward component is being advanced the roof setting pressure acting on the auxiliary structure is automatically reduced.

4 Claims, 2 Drawing Figures

MINE ROOF SUPPORTS

BACKGROUND TO THE INVENTION

The present invention relates in general to mine roof supports and more particularly to such supports having a main roof-engaging structure linked to an auxiliary roof-engaging structure at its front end.

It is well known to provide an auxiliary roof-engaging structure or extension cap on the main roof cap of a mine roof support which can take the form of a trestle, a shield support and/or a walking support. Such auxiliary roof-engaging structures are used to underpin the roof at the critical forward zone where it adjoins the mineral face. These structure can be designed to slide in and out towards the workface or to swing up and down. It is also known to provide a roof support with a multi-part auxiliary roof-engaging structure which itself is designed for swinging and has a sliding forward extension within or below a rear component pivotably linked to the main cap. This type of sliding extension does not generally underpin the roof over a sufficiently large area since it tends to engage on the roof at discrete separated points. To avoid this problem the sliding extension can be arranged on the rear component so that when the auxiliary structure is braced against the roof under relatively high setting pressure, the sliding extension likewise is braced against the roof over its full area. However in the braced or set condition it is not possible to move the sliding extension in and out and it has been necessary for personnel to manually adjust the setting pressure to permit adjustment of the sliding extension. This largely emperical control is disadvantageous since it can lead to temporary removal of all support for the roof over the critical forward zone which can result in partial roof collapse. A general object of the present invention is to provide an improved roof support structure.

SUMMARY OF THE INVENTION

In accordance with the invention the pressure which serves to hold a multi-part auxiliary roof-engaging structure of a mine roof support against the roof is automatically reduced whenever the forward component thereof is being displaced. A roof support constructed in accordance with the invention may thus have a main roof-engaging structure and a multi-part auxiliary roof-engaging structure carried by the main structure, the auxiliary roof-engaging structure being composed of a first component linked to the main structure and a second component slidably displaceable to extend and retract in relation to the first component, first hydraulic means for setting the auxiliary structure against the roof of a mine working, second hydraulic means for slidably displacing the second component in relation to the first component of the auxiliary roof-engaging structure and a hydraulic control arrangement associated therewith which operates on the first hydraulic means to automatically reduce the hydraulic setting pressure acting on the auxiliary structure whenever the second hydraulic means is operated to displace the second component of the auxiliary roof-engaging structure in relation to the first component thereof.

The first and second hydraulic means can take the form of double-acting piston and cylinder units.

The automatic pressure reduction can be achieved by connecting the working chamber of the piston and cylinder unit used to set the structure against the roof to the return line by way of a pressure relief valve. A control valve, which is automatically opened whenever pressure fluid is admitted to the working chamber of the piston and cylinder unit used for extending or retracting the second or forward component, can be used to establish the connection.

Multi-way valve devices can be connected to a pressure-fluid feed line, to said return line and to the first and second units. These devices serve selectively to extend and retract the units thereby to extend and retract the units to swing the auxiliary structure up and down and to extend and retract the forward component thereof.

Preferably, a further pressure-relief valve is connected between the said working chamber of the first unit and the return line and the further pressure-relief valve is set to open at a higher pressure than that at which the first-mentioned relief valve opens thereby to protect the construction against excess pressure.

The invention may be understood more readily, and various other aspects and features of the invention may become apparent, from consideration of the following description.

BRIEF DESCRIPTION OF DRAWING

An embodiment of the invention will now be described by way of example only, with reference to the accompanying drawing, wherein.

DESCRIPTION OF PREFERRED EMBODIMENT

Figure 1:
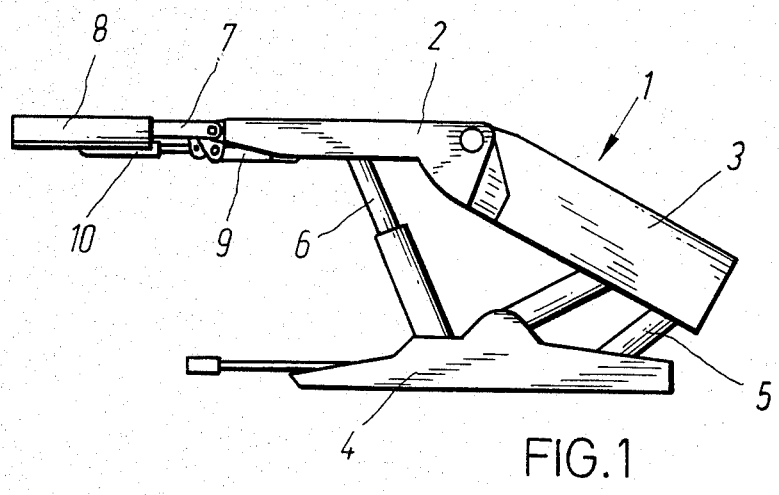
FIG. 1 is a diagrammatic side view of a roof support constructed in accordance with the invention.

As shown in FIG. 1, a roof support 1 is composed of a floor-engaging structure or skid 4, a main roof-engaging structure or cap 2, a goaf shield 3 and hydraulic props 6 disposed between the cap and the skid 4. The goaf shield is pivotably connected to the cap 2 and as is known guide levers 5 which form a lemniscate guide system link the shield 3 to the floor skid 4. At its front end, facing the mineral face during use, the main roof-engaging structure 2 is coupled to an auxiliary roof-engaging structure which can be swung up and down in known manner. The auxiliary structure is itself composed of a first component 7 and a second component 8 which forms a slidable extension. The component 7 is coupled with a linkage to the main cap 2 and to a piston and cylinder unit 9 which serves to swing the structure 7,8 up and down and to hold the structure 7,8 against the roof when desired. The component 8 can also be extended and retracted in relation to the component 7, towards and away from the mineral face during use, with the aid of a piston and cylinder unit 10 connected between the components 7,8. The structure 7,8 can thus be adjusted to cover the roof area between the structure 2 and the mineral face (not shown).

Figure 2:
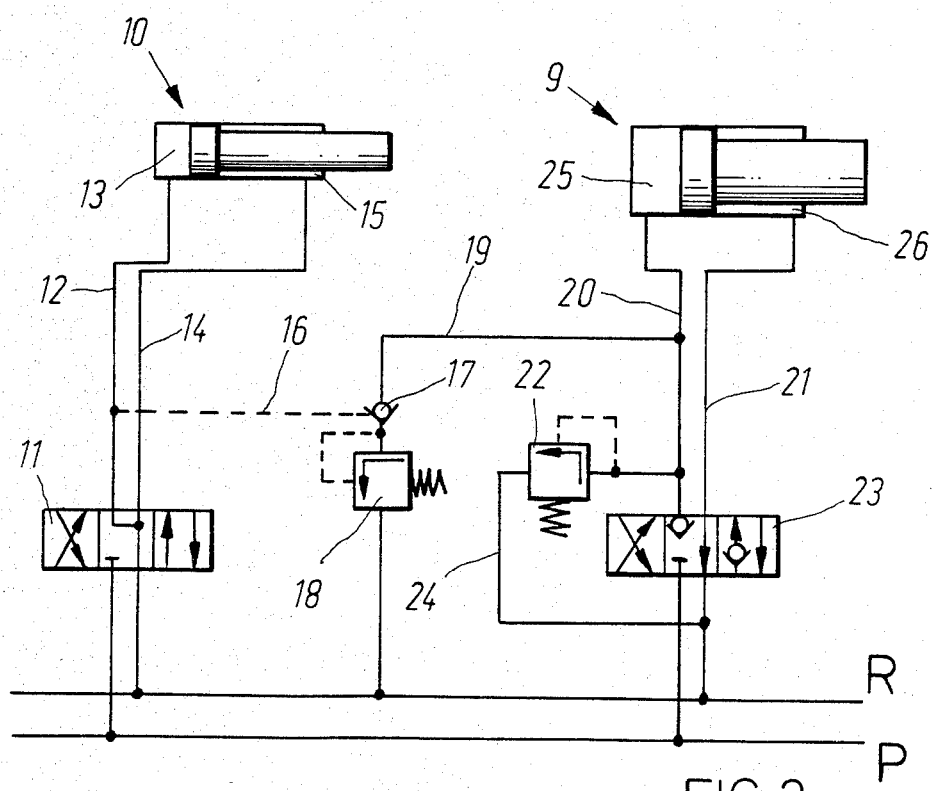
FIG. 2 is a block schematic diagram depicting the hydraulic control arrangement associated with the support shown in FIG. 1.

FIG. 2 depicts the hydraulic control arrangement pertaining to the units 9, 10 and constructed in accordance with the invention. As shown, a multi-way valve device 23 is connected to pressure fluid feed and return lines denoted P and R, respectively, and to the working chambers 25 and 26 of the unit 9 via lines 20, 21, respectively. A pressure-relief valve 22 is connected between the line 20 and the return line via a line 24. A non-return valve 17, which can be opened hydraulically, is connected in series with a further adjustable pressure-relief valve 18 in a line 19 extending from the line 20 back to the return line R. A similar multi-way valve device 11 is connected to the pressure fluid feed and return lines P,R and to the working chambers 13, 15 of the unit 10 via lines 12, 14 respectively. A control line 16 extends from the line 12 to the valve 17. The arrangement operates as follows: Assume that the devices 11, 23 are actuated so that the component 8 and hence the unit 10 is fully retracted and the structure 7,8 is braced against the roof by means of the unit 9. Under these conditions, the chamber 25 is exposed to the pressure prevailing in the line P, typically around 350 bars. In order to extend the component 8, the device 11 is actuated (right-hand position in FIG. 2) to connect the chamber 13 of the unit 10 to the pressure line P and the chamber 15 to the return line R. The unit 10 thus extends. At the same time the pressure in the line 12 acts via the control line 16 to open the valve 17. The relief valve 18 is set to open at a pressure of around 100 bars and hence with the valve 17 open the valve 18 will also open to permit the pressure in the chamber 25 to fall to 100 bars. This reduced setting pressure maintains the structure 7, 8 against the roof but permits the component 8 to slidably advance as desired. When the component 8 has been extended by the required amount, the device 11 is actuated (left-hand position in FIG. 2) to relieve the chamber 13 and hence the pressure in the line 16 falls to permit the valve 17 to close again. The pressure in the chamber 25 then rises to ensure the structure 7, 8 is fully set against the roof.

We claim:

1. A mine roof support, comprising: a main roof-engaging structure (2), a multi-part auxiliary roof-engaging structure carried by the main structure and including a first component (7) pivotably linked to the main structure and a second component (8) slidably displaceable to extend and retract in relation to the first component, first hydraulic means (9) for setting the auxiliary structure against the roof of a mine working, second hydraulic means (10) for slidably displacing the second component in relation to the first component of the auxiliary roof-engaging structure, and hydraulic control means (16–18) operatively associated with the first and second hydraulic means for automatically reducing the setting pressure applied to the auxiliary structure by the first hydraulic means in response to the second hydraulic means being actuated to displace the second component of the auxiliary roof-engaging structure in relation to the first component thereof, to thereby maintain a temporarily reduced but still adequate support of a forward zone of the roof while simultaneously enabling the more facile displacement of the second component.

2. A roof support according to claim 1, wherein the first and second hydraulic means are first and second piston and cylinder units, respectively, and the hydraulic control arrangement includes a pressure-relief valve (18) and a control valve (17) which is opened to connect the pressure-relief valve between a working chamber (25) of the first unit used for setting the auxiliary roof-engaging structure against the roof and a return line (R) when a pressure chamber (13) of the second unit is exposed to pressure fluid to displace the second component of the auxiliary roof-engaging structure relative to the first component thereof.

3. A roof support according to claim 2, wherein multi-way valve devices (11, 23) are provided which are connected to a pressure-fluid feed line, (P) to said return line and to the first and second units and which serve selectively to extend and retract the units.

4. A roof support according to claim 2, wherein a further pressure-relief valve (22) is connected between the said working chamber of the first unit and the return line and the further pressure-relief valve is set to open at a higher pressure than that at which the first-mentioned relief valve opens.

* * * * *